United States Patent [19]

Rumbaugh

[11] 4,060,049

[45] Nov. 29, 1977

[54] WATER SKI ROPE HANDLE

[75] Inventor: James T. Rumbaugh, Spirit Lake, Iowa

[73] Assignee: Berkley & Company, Inc., Spirit Lake, Iowa

[21] Appl. No.: 736,426

[22] Filed: Oct. 28, 1976

[51] Int. Cl.[2] ..... A63C 11/10

[52] U.S. Cl. ..... 115/6.1; 9/310 A

[58] Field of Search ..... 115/6.1; 114/253, 254; 9/310, 310 R

[56] References Cited

U.S. PATENT DOCUMENTS

| | | | |
|---|---|---|---|
| 3,219,007 | 11/1965 | Kiefer | 115/6.1 |
| 3,537,418 | 11/1970 | Brownson | 115/6.1 |
| 3,695,210 | 10/1972 | Stein | 115/6.1 |
| 3,830,188 | 8/1974 | Humbert | 115/6.1 |

*Primary Examiner*—Trygve M. Blix
*Assistant Examiner*—D. W. Keen
*Attorney, Agent, or Firm*—Schroeder, Siegfried, Ryan, Vidas & Steffey

[57] ABSTRACT

A water ski rope handle of molded plastic construction with floatation cavities in the handle portion and rope anchoring end caps rigidly secured to the ends of the same which provide for mounting of the rope with the knots in the ends of the rope being recessed to captivate the same and with the rope being angled from the handle to minimize fraying or wear thereof.

7 Claims, 3 Drawing Figures

WATER SKI ROPE HANDLE

This invention relates to water ski rope handle and more particularly to an improved water ski rope handle in which rope anchoring flanges provide finger guards for the user and a mounting of the rope to eliminate fraying thereon.

Water ski rope handles may take varying forms and are normally cylindrical or tubular members with rope anchoring apertures therethrough for anchoring a tow rope thereon.

The present invention is directed to an improved water ski rope handle which is made of a molded plastic material. It includes a handle member with rope anchoring flanges thereon which provide finger guards to insure that the rope connected to the handle will not contact the hands of the user and adversely affect the same. The molded design includes floatation cavities to insure floatation of the handle, and suitable grip material is mounted thereon for positive gripping of the handle by the user. Further, the rope anchoring flanges are inclined or angled in such a manner to minimize fraying of the rope at the connection of the same with the handle.

Therefore, it is an object of the invention to provide an improved water ski rope handle.

Another object of the invention is to provide a water ski rope handle of this type in which the handle mounts positive gripping cylinders therein and includes floatation cavities therein to insure floatation of the handle and positive gripping of the same by the user.

Another object of the invention is to provide an improved water ski rope handle with improved rope anchoring flanges which mount the rope in such a manner as to minimize fraying thereof while securing the rope to the handle to permit easy replacement of the same.

These and other objects of the invention will become apparent from the reading of the attached description together with the drawings.

Figure 1:
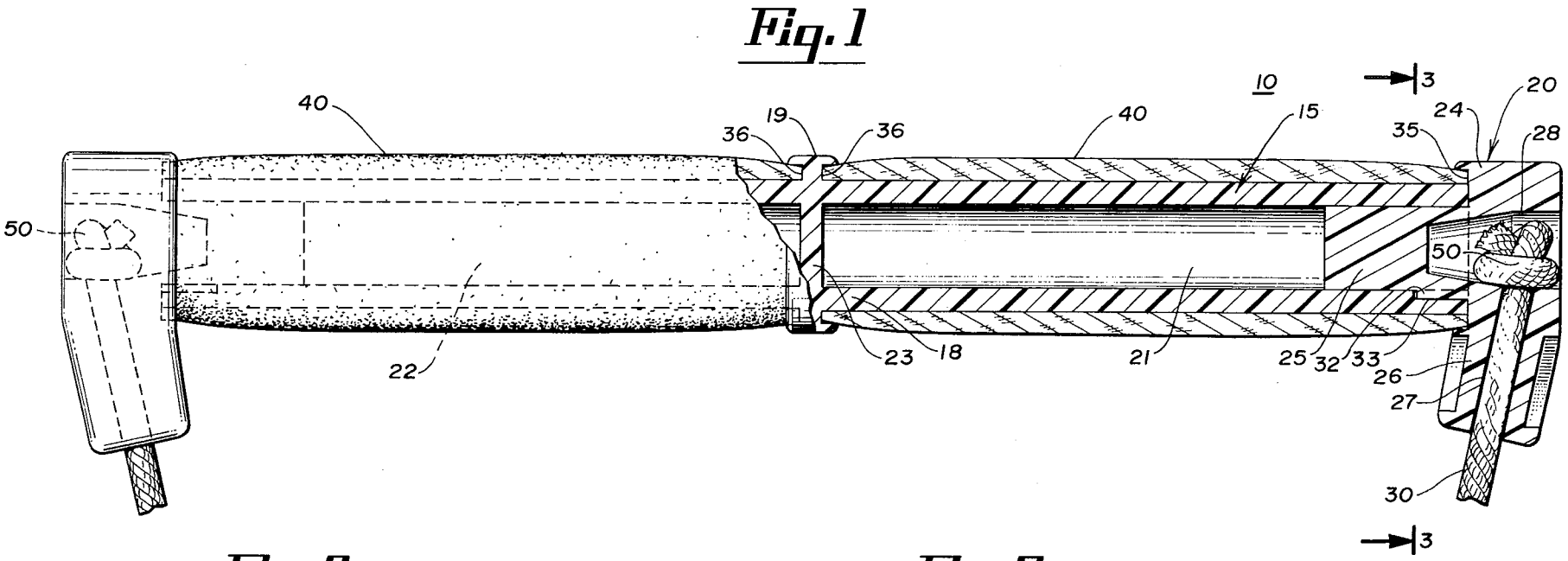
FIG. 1 is a plan view of the water ski rope handle.

My improved water ski rope handle is shown generally at 10 in FIG. 1. It is constructed of a molded plastic material to have strength and long life. The handle is comprised of a cylindrical handle portion, indicated generally at 15, with a pair of rope anchoring flanges, indicated generally at 20 anchored to the ends of the cylindrical handle portion. The rope anchoring flanges mount and secure the tow ropes 30 to the handle.

The handle portion 15 is an elongated cylindrical member 18 having a raised annular flange 19 positioned midway along the extent of the same and with recessed areas 21 and 22 extending from the ends to a solid central web 23 defining a pair of cavities in the ends of the handle.

The rope anchoring flanges are identical in construction and each have a cap portion 24 which is generally cylindrical in form with a plug portion 25 extending from the side thereof and a flange portion 26 formed integral with the cap portion and extending at an angle thereto. The flange portions have an aperture 27 extending from the end of the same into the cap portion and terminating in a recess 28 in the cap portion opposite the extension of the plug portion 25.

Figure 3:
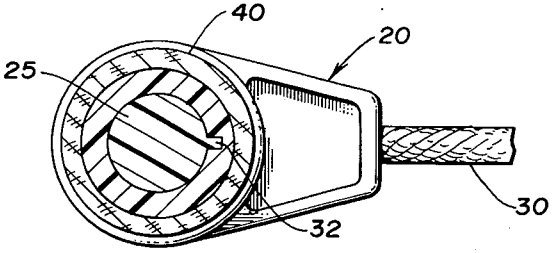
FIG. 3 is a sectional view of the water ski rope handle and FIG. 1 taken along the lines 3—3 therein.
Figure 2:
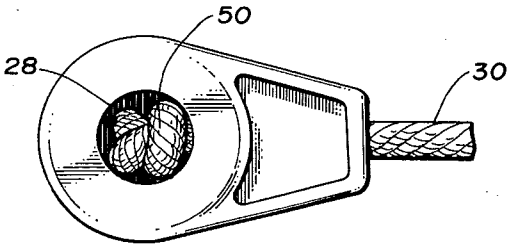
FIG. 2 is an end elevation view of the same.

As will be best seen in FIGS. 1 and 3, the plug portion has a key section 32 adjacent the cap portion 24, and the plug portion is of a cylindrical dimension so as to snugly fit into the cylindrical recesses 21, 22 of the handle portion 15. A suitable keyway 33 is positioned in the ends of the recesses adjacent the ends of the handle portion to receive the key section of the flanges to the handle portion and locate the flanges on the handle portion. The flanges are of a molded plastic material and the plug portions when inserted into the recesses will be ultrasonically welded or adhesively bonded to the handle portion to secure the flanges thereon. With the plug portions inserted into the recesses, tight floatation cavities are formed in the handle portion to provide for floatation of the water ski handle.

As will be seen in FIGS. 1 and 3, the cap portions 24 of the rope anchoring flanges have annular recessed surfaces 35 therein. Similarly, the raised annular flange 19 has recessed surfaces 36 on either side of the same. Before the rope anchoring flanges 20 are welded to the handle portion 15, cylindrical gripping members 40 are mounted on the handle portion. The gripping members have ends which fit into the recessed portions 35, 36 of the flanges 19, 20 to captivate the same on the handle portion and prevent snagging and tearing of the gripping members 40. The gripping material is preferably of a foamed type substance and the members are suitably glued or having a snug press fit to the surfaces of the handle portion 18 on either side of the centrally located flange 19 to provide a positive gripping surface for the handle.

The rope anchoring flanges with the apertures 27, therein provide for the passage of the tow ropes 30 into the rope anchoring flanges. The flanges are angled toward one another at an angle of approximately 15° to the cap portion making an approximate mounting angle with the general extent of the handle portion of about 75°. This will incline the ends of the rope anchoring flange toward one another so that the two rope 30 may be tied to a single line and side thrust against the rope and rubbing of the rope will be mainimized. This will reduce the possibility of fraying the rope.

The ends of the rope have a suitable knot, such as is indicated at 50, tied therein, and the rope is drawn back through the rope anchoring flange so that each knot resides in the recess 28 in the cap portions 24 of the rope anchoring flanges to conceal the same and protect the knots from becoming untied. The tension on the tow rope is such that the knots will be held against the rope anchoring flange and concealed within the aperture to provide a positive connection at this point. However, whenever it is desired to replace the tow rope, the knotted portions 50 may be drawn out of the recesses 28 in the rope anchoring flanges and untied so that the rope may be withdrawn from the rope anchoring flanges and new rope replaced in the same manner. Thus, the recesses 28 in the rope anchoring flanges are such as to captivate the rope and prevent slippage from the handle.

The improved water ski rope handle provides a structure in which the hands of the user are protected from the exposed ends of the rope by means of the flange portions 26 thereof eliminating the possibility of cutting or abraiding the fingers or hands of the user. The molded plasitc design of the water ski handle with the floatation cavities therein a water ski handle which will float and yet have excellent wear characteristics. The rope anchoring flanges also captivate the gripping material which is slipped over the handle portion to positively secure the same and prevent breakage thereof. The improved rope anchoring handle positively secures the rope to the handle in such a manner that new rope is easy to install or replace. It mounts the rope to the handle so as to prevent fraying or undue wear of the rope.

Therefore, in considering this invention, it should be remembered that the present disclosure is illustrative only and the scope of the invention should be determined by the appended claims.

What I claim is:

1. A water ski rope handle comprising: a cylindrical handle portion having a pair of hollow recesses therein and extending from opposite ends of the same, a pair of rope anchoring flanges mounted on the ends of the cylindrical handle portion, said flanges having ski rope anchoring portions and plug portions with the plug portions extending translationally from the achoring portions and being positioned into the recesses in the ends of cylindrical handle portion closing the same to define floatation cavities therein and mounting the flanges on the handle portion, said rope anchoring portions each having an aperture formed therein extending therethrough to the plug portion terminating in an exposed recess therein, said flanges being adapted to receive the ends of the tow rope to extend through the apertures in the rope anchoring portions with the rope being secured by knots at the ends of the same located in the exposed recesses of the rope anchoring the flanges, said rope anchoring flanges being inclined to the extent of the cylindrical portion by approximately 75°

2. The water ski rope handle of claim 1 in which the plug portions of the flanges have a raised key portion thereon and the ends of the recesses in the handle portion have suitable detents to positively locate the flanges on the handle extending parallel to one another in the same direction and inclined toward one another.

3. The water ski rope handle of claim 2 in which the handle portion has an annular raised flange midway along its extent.

4. The water ski rope handle of claim 3 and including cylindrical grip members positioned over the handle portion on either side of the raised flange thereon and being held thereon by the rope anchoring flanges.

5. The water ski rope handle of claim 4 in which the grip members edges at the extremities of the same fit into grooved surfaces in the raised flange on the handle portion at one extremity and into grooved surfaces in the rope anchoring portion of the rope anchoring flanges at the outer extremity.

6. The water ski rope handle of claim 5 in which the handle portion and the rope anchoring flanges are made of a molded plastic material with the flanges being ultrasonically welded to the handle portion.

7. The water ski rope handle of claim 6 in which the handle portion and the rope anchoring flanges are made of a molded plastic material with the flanges being adhesively bonded to the handle portion.

* * * * *